United States Patent [19]

Bussiere

[11] 4,055,939

[45] Nov. 1, 1977

[54] SPINNING MACHINE

[76] Inventor: Lawrence S. Bussiere, 49 Hagop Road, Salem, N.H. 03079

[21] Appl. No.: 712,036

[22] Filed: Aug. 5, 1976

[51] Int. Cl.[2] ..... D01H 11/00; D01H 1/28

[52] U.S. Cl. ..... 57/62; 242/18 DD

[58] Field of Search ..... 57/1 R, 34 R, 59, 62, 57/92, 94, 97, 112, 58.49, 58.7, 58.72; 242/18 DD

[56] References Cited

U.S. PATENT DOCUMENTS

| | | | |
|---|---|---|---|
| 2,048,787 | 7/1936 | Elvin et al. | 57/62 |
| 2,745,239 | 5/1956 | Kingsbury | 57/59 X |
| 2,843,998 | 7/1958 | Schlums | 57/59 |

FOREIGN PATENT DOCUMENTS

| | | | |
|---|---|---|---|
| 758,989 | 1/1934 | France | 57/62 |
| 1,170,544 | 1/1959 | France | 242/18 DD |
| 1,192,023 | 10/1959 | France | 57/62 |
| 499,563 | 11/1929 | Germany | 57/62 |
| 545,567 | 2/1932 | Germany | 57/62 |
| 1,004,795 | 9/1965 | United Kingdom | 242/18 DD |

*Primary Examiner*—Donald Watkins

*Attorney, Agent, or Firm*—Norman S. Blodgett; Gerry A. Blodgett

[57] ABSTRACT

Spinning machine having platform for rotating roving cheese, having a driving roll, having an inclined rack element carrying a receiving spool, the spool being free to move down the rack under the influence of gravity toward contact with the drive roll.

11 Claims, 2 Drawing Figures

SPINNING MACHINE

BACKGROUND OF THE INVENTION

In the formation of yarn from roving, it is common practice to twist the roving while subjecting it to a stretching and smoothing operation; a typical apparatus for performing this treatment is shown in the U.S. Pat. of Franzen et al. U.S. Pat. No. 3,924,392 issued Dec. 9, 1975. In such prior art machines the roving passes downwardly from a horizontal package roll to a vertical spindle where a yarn package is formed. When such apparatus is used to convert roving of certain materials, many problems exist. For instance, when the roving is made of asbestos, a considerable quantity of lint and dust is formed. While in the past this dust presented only housekeeping problems, it has recently been discovered that asbestos dust can lead to lung disease and, possibly, to cancer. Governmental agencies, such as that operating under the Occupational Safety and Health Act (OSHA), have suggested that spinning machines that cause asbestos dust to be expelled into the air should not be used. These and other difficulties experienced with the prior art apparatus have been obviated by the present invention.

It is, therefore, an outstanding object of the invention to provide a spinning machine for forming yarn from roving without the generation of lint.

Another object of this invention is the provision of a spinning machine for twisting asbestos roving and generating a package without expelling dust into the air.

A further object of the present invention is the provision of a spinning machine of a low profile design all parts of which are accessible to a person of normal height standing on the supporting floor.

It is another object of the instant invention to provide a spinning machine which is simple in construction, which is inexpensive to manufacture, and which is capable of a long life of useful service with a minimum of maintenance.

With these and other objects in view, as will be apparent to those skilled in the art, the invention resides in the combination of parts set forth in the specification and covered by the claims appended hereto.

SUMMARY OF THE INVENTION

In general, the invention consists of a spinning machine having a supporting structure and having a platform mounted on the structure for rotation about a vertical axis, the platform having a horizontal upper surface for receiving a cheese of roving. A drive roll is mounted on the structure for rotation about a horizontal axis that is spaced from the said vertical axis and means is provided for driving the platform and the drive roll at selected relative speeds. A rack element is mounted on the structure and provides surfaces lying in a plane lying parallel to and spaced from the said horizontal axis, the plane lying at an acute angle to the said vertical axis. A receiving spool on which the yarn is coiled is carried on the rack and is free to rotate about a horizontal axis parallel to and spaced from the said horizontal axis. The spool is free to move under the influence of gravity toward contact with the drive roll.

More specifically, the rack element is provided with two spaced, parallel bars having upwardly-directed surfaces lying in the said plane. The receiving spool is provided at each end with a concentric wheel which rides on the surface of its respective bar of the rack. The bars are formed with vertical flanges along the outer edges, the flanges engaging the end surfaces of the wheels to inhibit longitudinal movement of the receiving spool relative to the rack.

Also, a pot is carried on the platform to contain the roving cheese and a cover with a central aperture closes the pot. A grid formed of rods is carried on the cover overlying the aperture. A fixed guide finger extends from the structure and carries at its outer end a loop which lies directly over the aperture and the grid.

Furthermore, a guide means is slidably mounted on the structure for movement back-and-forth in front of the receiving spool. A cam mounted on a cam shaft which is rotated, the cam acting on the guide means to bring about the said movement.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
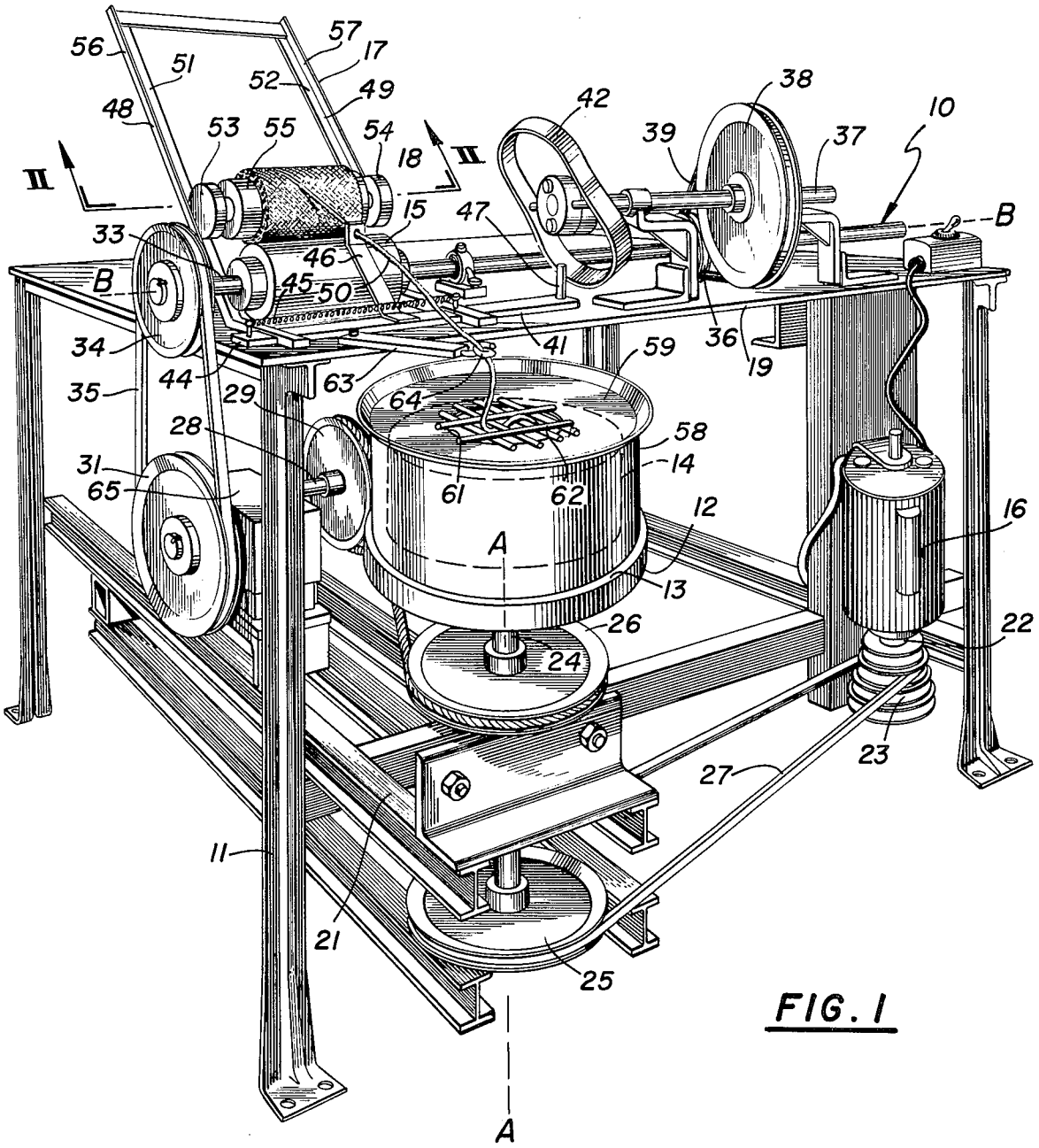
FIG. 1 is a perspective view of a spinning machine incorporating the principles of the present invention.
Figure 2:
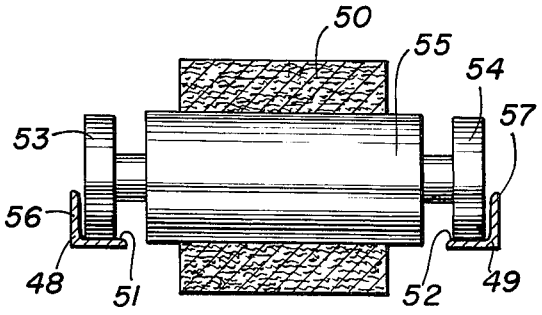
FIG. 2 is a sectional view of a portion of the machine taken on the line II—II of FIG. 1.

Referring to the drawing, the spinning machine, indicated by the reference numeral 10, is shown as having a supporting structure 11 on which is carried a platform 12. The platform has a horizontal upper surface 13 adapted to receive a roving cheese 14 for rotation about a vertical axis A—A. A drive roll 15 is mounted on the supporting structure for rotation about a horizontal axis B—B that is substantially spaced from the aforementioned vertical axis A—A. Means, including a motor 16, is provided to drive the platform 12 and the drive roll 15 at selected relative speeds. A rack element 17 is mounted on the structure and lies in a general plane lying parallel to and spaced from the said horizontal axis B—B, and also lying at an acute angle to the vertical axis A—A. A receiving spool 18 is carried on the rack 17 for rotation about a horizontal axis that is parallel to and spaced from the said horizontal axis B—B. The spool is free to roll under the influence of gravity toward contact with the drive roll 15.

The supporting structure 11 consists of a framework having an upper shelf 19 on which the drive roll 15 and the rack element 17 are mounted and having a lower shelf 21 on which the platform 12 is mounted. The drive motor 16 is mounted on the framework with its output shaft 22 arranged vertically and carrying a first pulley 23. The platform 12 is provided with a vertically-extending shaft 24 on which is mounted a second pulley 25 and a third pulley 26. A flexible pulley 27 joins the first pulley to the second pulley in driving relationship. An intermediate shaft 28 is rotatably mounted on the lower shelf 21 with its axis horizontal. The shaft carries an input pulley 29 and works through a gear reduction unit 65 to an output pulley 31. A flexible belt 32 joins the said third pulley to the said input pulley in driving relationship. The drive roll 15 is mounted on a horizontal shaft 33 having an input shaft 34 that overlies the output pulley 31 on the intermediate shaft. A flexible belt 35 joins the pulleys 31 and 34 in driving relationship.

As has been stated, the drive roll 15 is mounted on a horizontal shaft 33 which, in turn, is rotatably carried in bearings. The shaft extends across the framework a substantial distance and carries an output pulley 36 at its outer end. A cam shaft 37 is mounted in bearings on the structure for rotation about an axis extending parallel to and spaced from the drive roll shaft 33. A pulley 38 is mounted on the cam shaft 37 and a flexible belt.

A guide means 41 is slidably mounted on the structure for movement to-and-fro in front of the receiving spool 18 and a cam 42 is mounted on the cam shaft 37 and acts on the guide means to bring about the said movement. The cam is in the form of a loop of flat stock mounted on the end of the cam shaft so as to present an inclined edge 43 facing the guide means. The guide means consists of a flat strip 44 suitably carried in guides for the said movement and resiliently urged toward the cam 42 by a coil spring 45. An apertured finger 46 is mounted on the strip and extends upwardly in front of the drive roll 15. A cam follower 47 extends upwardly from the strip for engagement with the edge 43 of the cam.

The rack 17 is made up of two spaced, parallel bars 48 and 49 having upwardly-directed surfaces 51 and 52, respectively. The surfaces lie in the same plane and the receiving spool 18 is provided with concentric wheels 53 and 54 which ride on the said surfaces of the bars. The receiving spool has a main body 55 of generally cylindrical form. The bars 48 and 49 are formed with flanges 56 and 57, respectively, extending along the outer edges at a right angle to the surfaces. The inwardly-facing surfaces of the flanges engage the end surfaces of the wheels 53 and 54 to inhibit longitudinal movement of the receiving spool relative to the rack.

A pot 58 is carried on the upper surface 13 of the platform 12 and is adapted to contain the cheese 14. A cover 59 with a central aperture 61 closes the pot. A grid 62 formed of rods is welded to the cover and overlies the aperture. A fixed guide finger 63 extends forwardly from the structure and carries at its outer end a loop 64 of rod which overlies the said aperture 61 and the grid and through which the yarn 50 passes from the cheese 14. The main body 55 of the receiving roll and the main body of the drive roll 15 are of the same length.

The operation of the invention will now be understood in view of the above description. With the motor 16 energized and rotating, the output shaft 22 and the pulley 23 also rotate to drive the pulley 25 through the medium of the belt 27. The driving of the pulley 25 rotates the vertical shaft 24; this rotates the platform 12 along with the pot 58. At the same time, it rotates the pulley 26 which operates through the belt 32 to drive the pulley 29. The rotation of the pulley 29 causes the rotation of the shaft 28 and the pulley 31 (through the gear reduction unit 65). The output pulley 31 acts through the belt 35 to rotate the pulley 34 and the shaft 33. The shaft 33 carries and rotates the drive roll 15 which presses against the accumulated yarn on the main body 55 of the receiving spool 18 and serves to wrap more yarn on the spool. As the yarn advances onto the spool, it is also moved from side to side by the guide finger 46. The finger is moved as part of the guide means 41 under the impetus of the cam 43 which, in turn, is rotated by the shaft 33 operating through the pulley 36, the belt 39, the pulley 38, and the cam shaft 37. As the yarn builds up on the spool 18, it moves up the rack element 17 and, because of the fact that the main body lies in a space between the bars 48 and 49, the size of the yarn package can be very large.

The advantages of the invention can now be readily understood in view of the above discussion. The fact that the roving passes in a sinuous path around the rods of the grid 62 and then is pressed by gravity onto the surface of the drive roll, means that there is no location where lint and dust is projected into the air. The result is a very clean and healthy spinning operation. The passage of the roving through the grid 62 means that the twist is not carried back into the roving in the pot, so that it snarls do not occur. The movement of the spool along the rails on the rack element 17 permits the package on the spool to grow longer without the danger of the spool jamming on its support.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A spinning machine, comprising a. a supporting structure, b. a platform having a horizontal upper surface for receiving a roving cheese and supported on the structure for rotation about a vertical axis, c. a drive roll mounted on the structure for rotation about a horizontal axis that is substantially spaced from the said vertical axis, d. means driving the platform and the drive roll at selected relative speeds, e. a rack element mounted on the structure and defining a plane, the plane lying parallel to and spaced from the said horizontal axis, the plane lying at an acute angle to the said vertical axis, and f. a receiving spool on which the yarn is coiled, the spool being carried on the rack for rotation about a horizontal axis parallel to and spaced from the said horizontal axis, the spool being free to move under the influence of gravity toward contact with the drive roll.

2. Spinning machine as recited in claim 1, wherein the supporting structure consists of a framework having an upper shelf on which the drive roll and the rack element are mounted and having a lower shelf on which the platform is mounted.

3. Spinning machine as recited in claim 2, wherein a drive motor is mounted on the framework with its shaft arranged vertically and carrying a first pulley, wherein the platform is provided with a vertically-extending shaft on which is mounted a second and a third pulley, and wherein a flexible belt joins the first pulley to the second pulley in driving relationship.

4. Spinning machine as recited in claim 3, wherein an intermediate shaft is rotatably mounted on the lower shelf with its axis horizontal, the shaft carrying an input pulley and a output pulley, wherein a flexible belt joins the said third pulley to the said input pulley in driving relationship.

5. Spinning machine as recited in claim 4, wherein the drive roll is mounted on a horizontal shaft having an input pulley overlying the output pulley on the intermediate shaft, and wherein a flexible belt joins the output pulley of the intermediate shaft to the input pulley of the drive roll shaft in driving relationship.

6. Spinning machine as recited in claim 1, wherein the drive roll is mounted on a horizontal shaft that extends a substantial distance from the roll to an end carrying an output pulley, wherein a cam shaft is mounted in bearings on the structure for rotation about an axis extending parallel to and spaced from the drive roll shaft, wherein a pulley is mounted on the cam shaft, wherein a flexible belt connects the cam shaft pulley to the drive roll shaft pulley, wherein a guide means is slidably mounted on the structure for movement to-and-fro in front of the receiving spool, and a cam mounted on the cam shaft and acting on the guide means to bring about the said movement.

7. Spinning movement as recited in claim 6, wherein the cam is in the form of a loop mounted on the end of the cam shaft so as to present an inclined edge facing the guide means, wherein the guide means consists of a flat strip suitably carried in guides for the said movement and resiliently urged toward the cam, wherein an apertured finger is mounted on the strip and extends upwardly in front of the drive roll, and wherein a cam follower extends upward from the strip for engagement with the cam edge.

8. Spinning machine as recited in claim 1, wherein the rack element is provided with two spaced, parallel bars having upwardly-directed surfaces lying in the said plane, wherein the receiving spool is provided at each end with concentric wheels which ride on the surfaces of the bars, and wherein the receiving spool has a main body of generally cylindrical form.

9. Spinning machine as recited in claim 8, wherein the bars are formed with vertical flanges along the outer edges, the flanges engaging the end surfaces of the wheels to inhibit longitudinal movement of the receiving spool relative to the rack.

10. Spinning machine as recited in claim 1, wherein a pot is carried on the platform to contain the roving cheese, wherein a cover with a central aperture closes the pot, wherein a grid formed of rods is carried on the cover overlying the aperture, and wherein a fixed guide finger extends from the structure and carries at its outer end a loop of rod overlying the said aperture and grid, the roving passing from the cheese, through the aperture, is woven in a sinuous path through the rods of the grid, and passes through the loop at the end of the fixed guide finger on its way to the receiving spool.

11. Spinning machine as recited in claim 1, wherein the receiving spool and the drive roll are provided with generally cylindrical main bodies having substantially the same length.

* * * * *